US009827161B2

(12) United States Patent
Ruf

(10) Patent No.: US 9,827,161 B2
(45) Date of Patent: Nov. 28, 2017

(54) CHAIR FOR RELIEVING BACK PAIN

(71) Applicant: EEM AG, Sulgen (CH)

(72) Inventor: Hans Ruf, Zaisertshofen (DE)

(73) Assignee: EEM AG, Sulgen (CH)

( * ) Notice: Subject to any disclaimer, the term of this patent is extended or adjusted under 35 U.S.C. 154(b) by 58 days.

(21) Appl. No.: 14/169,362

(22) Filed: Jan. 31, 2014

(65) Prior Publication Data

US 2014/0210236 A1 Jul. 31, 2014

(30) Foreign Application Priority Data

Jan. 31, 2013 (EP) ..... 13153460

(51) Int. Cl.

| | |
|---|---|
| ***A61H 1/02*** | (2006.01) |
| ***A47C 7/38*** | (2006.01) |
| ***A47C 1/03*** | (2006.01) |
| ***A47C 1/035*** | (2006.01) |

(52) U.S. Cl.

CPC ..... *A61H 1/0292* (2013.01); *A47C 1/03* (2013.01); *A47C 1/035* (2013.01); *A47C 7/38* (2013.01); *A61H 1/0218* (2013.01); *A61H 1/0229* (2013.01); *A61H 2201/0149* (2013.01); *A61H 2201/0176* (2013.01); *A61H 2201/0207* (2013.01); *A61H 2201/1664* (2013.01);

(Continued)

(58) Field of Classification Search

CPC ..... A61G 2200/52; A47C 1/03; A47C 1/035; A47C 7/38; A47C 1/034; A61H 1/0292; A61H 1/0218; A61H 2201/1676; A61H 2201/0207; A61H 2201/0176; A61H 2201/0149; A61H 2201/5061; A61H 2201/1664

USPC ..... 297/411.1, 284.5, 423.5, 466, 344.12, 297/344.18, 452.41, 217.2, 313, 188.1, 297/330, 327, 325, 344.19, 284.11, 297/423.35, 463.1, 423.4; 601/5

See application file for complete search history.

(56) References Cited

U.S. PATENT DOCUMENTS

| | | | | |
|---|---|---|---|---|
| 516,493 | A * | 3/1894 | Knight | A47C 1/035 297/423.35 |
| 1,527,754 | A * | 2/1925 | Simon | 601/24 |
| 1,922,418 | A * | 8/1933 | Conant | 297/357 |

(Continued)

FOREIGN PATENT DOCUMENTS

| | | | |
|---|---|---|---|
| CN | 103504852 | A * | 1/2014 |
| DE | 19702171 | | 7/1998 |

(Continued)

*Primary Examiner* — Milton Nelson, Jr.

(74) *Attorney, Agent, or Firm* — Davis & Bujold PLLC; Michael J. Bujold

(57) ABSTRACT

A chair (1) for relieving back pain of a user, with a seat surface (2) and a backrest (3), wherein a backrest angle (4) between backrest (3) and seat surface (2) is adaptable. At least one support element (5) for supporting the upper body of the user, when the latter is in an intended sitting position, is arranged on the backrest (3), wherein the support element (5), in the intended sitting position, can preferably be arranged, or is arranged, under the armpits of the user. The support element (5) is designed in such a way, and arranged on the backrest in such a way, that it can be moved by the user in order to obtain a desired support of the upper body at a predefined backrest angle (4) while he is in the intended sitting position.

25 Claims, 4 Drawing Sheets

(52) U.S. Cl.
CPC ..... *A61H 2201/1676* (2013.01); *A61H 2201/5061* (2013.01)

(56) References Cited

U.S. PATENT DOCUMENTS

| | | | | | |
|---|---|---|---|---|---|
| 2,544,896 | A * | 3/1951 | Nidetch et al. | 297/250.1 | |
| 3,189,345 | A * | 6/1965 | Simpson | A61G 7/1017 | 280/250.1 |
| 3,233,255 | A * | 2/1966 | Propst | A61G 7/015 | 5/610 |
| 4,621,804 | A * | 11/1986 | Mueller | A47D 13/043 | 135/67 |
| 4,688,557 | A * | 8/1987 | Bradstreet | A61H 1/0218 | 297/330 |
| 4,860,733 | A * | 8/1989 | Parker, Jr. | A61H 1/0292 | 297/330 |
| 4,966,413 | A * | 10/1990 | Palarski | A47C 1/022 | 297/284.6 |
| 5,088,476 | A * | 2/1992 | Burton | A61H 1/0229 | 606/241 |
| 5,090,770 | A * | 2/1992 | Heinrichs | A47C 3/30 | 188/300 |
| 5,863,095 | A * | 1/1999 | Rivard et al. | 297/230.13 | |
| 6,237,994 | B1 * | 5/2001 | Bentley | A47C 1/023 | 297/118 |
| 7,469,963 | B2 * | 12/2008 | Rutty | 297/230.1 | |
| 2005/0017565 | A1 * | 1/2005 | Sprouse, II | 297/452.41 | |
| 2013/0261510 | A1 * | 10/2013 | Anderson | A61H 1/02 | 601/5 |

FOREIGN PATENT DOCUMENTS

| | | | | |
|---|---|---|---|---|
| DE | 102009030390 | | 12/2010 | |
| EP | 0299839 | A1 * | 1/1989 | A61G 5/061 |
| FR | 2979230 | A1 * | 3/2013 | A61G 5/045 |
| JP | 09327347 | A * | 12/1997 | |
| JP | 2000140029 | A * | 5/2000 | |
| JP | 2006075177 | A * | 3/2006 | |
| NL | DE 4319125 | A1 * | 12/1994 | A47B 91/028 |
| WO | 02/24125 | | 3/2002 | |
| WO | 03/051159 | | 6/2003 | |

* cited by examiner

CHAIR FOR RELIEVING BACK PAIN

FIELD OF THE INVENTION

The invention relates to a chair for relieving back pain in accordance with the preamble of the independent claim.

BACKGROUND OF THE INVENTION

Chairs for improving wellbeing; for example massage chairs, are widely known.

A comfort chair for relieving the vertebral column is known from DE 10 2009 030 390. The chair comprises mechanically adjustable armpit supports, which help relieve the vertebral column. Moreover, the backrest of the chair is designed to be tiltable. A disadvantage of such a design of the chair is that the height setting of the armpit support has to be predefined before use and cannot be adjusted independently by the user when he is in the sitting position. In addition, an effective extension force is closely coupled to the inclination of the backrest.

A chair for relieving the vertebral column is known from U.S. Pat. No. 1,356,356. The chair has an armpit support and a headrest, which are adjustable independently of each other. The bearing surfaces for armpits and head are very small, such that an extension of the vertebral column distributes the entire bodyweight of a user exclusively over a very small surface area. This chair is therefore not pleasant to use.

SUMMARY OF THE INVENTION

The object of the invention is therefore to avoid the disadvantages of the prior art and, in particular, to create a chair and a table permitting pleasant, effective and widely adjustable relief of the back while simultaneously working.

In particular, the object is achieved by a chair for relieving back pain of a user, with a seat surface and a backrest, wherein a backrest angle between backrest and a vertical is adaptable. At least one support element for supporting the upper body of the user, when the latter is in an intended sitting position, is arranged on the backrest, wherein the support element, in the intended sitting position, can preferably be arranged, or is arranged, under the armpits of the user. The support element is designed in such a way, and arranged on the backrest in such a way, that it can be moved by the user in order to obtain a desired support of the upper body at a predefined backrest angle while he is in the intended sitting position.

Here, "vertical" designates a direction of the effect of gravity. A chair of this kind allows a user to adjust the backrest angle and also to adapt the support, afforded by the support elements, to his personal pain level or his personal wellbeing. By predefining the backrest angle, a maximum available extension force can be limited. By means of the adjustable support element, the actual effective extension force can be adjusted by the user according to his wishes.

In an advantageous embodiment of the invention, the support elements are provided with an electric drive. The latter permits simple adjustment, if appropriate also by remote control. It is also conceivable, however, to provide the support elements with a spring catch mechanism, so as to allow operation via the pressure of the upper arm or armpit on the support element.

A chair of this kind can advantageously be provided with operating elements, via which the support element can be moved by a user in the intended sitting position. The operating elements are in this case preferably arranged in the area of an armrest of the chair. In this way, the support element can be moved particularly easily by the user.

Alternatively, the operating element can be arranged near the seat surface, for example on the underside or at the side of a seat cushion or in the form of an operating handle arranged on the chair, underneath the seat surface.

The operating elements are preferably arranged such that they can be operated with one hand. Alternatively, for example, each support element can be controlled by operating elements that are arranged on the corresponding side of the chair and that can be reached by the corresponding hand of the user on the respective side of the support element.

The operating elements can be arranged on an operating console, which is movable as a separate unit relative to the chair, for example designed as a remote control that is connected by cable or without cable to a base station located on the chair. The user can then easily take hold of the operating console at any time, irrespective of the position of the chair. A retaining device for the operating console is preferably provided on the chair, for example in the armrest area.

The backrest angle is defined as the angle between the backrest and the vertical. In a sitting position, the backrest angle is typically 0° to 10° for example. The backrest angle can be up to 90', which corresponds to a horizontal position. A backrest angle of 60°, for example, has proven to be a comfortable lying position. It will be appreciated that the seat surface can be oriented with respect to the vertical independently of the backrest. An angle between backrest and seat surface can thus be set independently of the backrest angle, preferably in the range of 90° to 180°. At an angle between backrest and seat surface of 180° for example, the chair can also be used in the manner of an inclined bed.

To support the relief of the vertebral column, the therapy chair can be designed in such a way that a rocking movement, at least of the backrest, can be effected in particular in the forward and backward direction. This can take place under the control of a motor, for example, or can be effected by the user himself. For this purpose, the backrest can be sprung in relation to the seat surface for example, such that the backrest is periodically pivotable in the event of a corresponding movement of the user. Likewise, the backrest can be pivotable with respect to the seat surface under the control of a motor, e.g. with an adjustable period.

In this way, it is possible, on the one hand, to prevent a static position from becoming unpleasant to the user. On the other hand, a dynamically varying relief of the vertebral column may lead to a more efficient action of the therapy chair. It will be appreciated that the seat surface is also mounted pivotably on a stand of the chair so as to rock together with the backrest, or the whole chair can be designed to rock in the manner of a rocking chair.

The support element, in particular a bearing surface of the support element, is preferably designed with a soft surface, such that it is pleasant to use. The operating elements can be secured on the chair or can also be connected wirelessly to the control system of the chair. This is preferably an electronic control system, which controls an adjustment of the support element and of the backrest. Of course, the operating element can also control other movable parts of the chair.

The backrest and the support element can be adaptable simultaneously by the user, if appropriate preferably with the operating elements, wherein two support elements are preferably present. In particular, the backrest and the support element are adjustable independently of each other via the operating elements, and, in the case of two support elements, the latter are preferably movable in a synchronously coupled manner. In the case of two support elements, they are preferably arranged on both sides of the upper body of the user when he is in the intended sitting position. In this case, each of the two support elements is provided to support the user in a respective armpit region and/or upper arm region.

Each support element can be separately adjustable, or the support elements can be adjustable jointly. The support elements can also firstly be brought to a defined position relative to each other and can then be moved jointly. In this way, the chair meets the needs of those users who require a specific asymmetric arrangement of the support elements, yet it still permits simple adjustability of the support elements.

By the distribution of the bodyweight on the backrest and the support elements, the wellbeing on the chair can be enhanced by simultaneous adaptability. In particular, at a predefined backrest angle, the support element can be adjusted or readjusted in such a way that a load is felt comfortable even upon prolonged use. Moreover, the user can adjust the chair at any stage during his time on the chair, without leaving the position on the chair. This optimizes the effect of the chair.

In an advantageous embodiment of the invention, the support elements can be brought into a stand-by position that makes it easier for the user to get into and out of the chair and that allows the chair to be used without the support elements. For this purpose, the support elements can be foldable or rotatable, for example they can have a joint or hinge. The support elements can, for example, be brought from the operating position into the plane of the backrest. The support elements can be folded away from the backrest, can be recessed in the backrest or can be pushed behind the backrest.

The support elements can be brought into and out of the stand-by position by mechanical pressure.

The support elements can be brought into and out of the stand-by position under the control of an operating element that is preferably arranged close to other operating elements for control of the support elements, for example in the area of the armrests or on an operating console.

Moreover, an adjustable headrest can be arranged on the chair and designed in such a way that an extension of the cervical spine of the user can additionally be obtained, wherein the headrest is preferably adjustable by the user, if appropriate preferably with the operating elements.

An adjustable headrest of this kind permits relief of the cervical spine by the exact extent set by the user. A safety means can advantageously be provided which restricts an adjustment of the headrest with respect to the support element, such that a load on the cervical spine is limited.

The headrest is in this case designed such that it offers the user a bearing surface for chin and/or mandible, particularly in the form of a U-shaped headrest that can be fitted around the back of the neck and under the jaw or chin. However, it would also be conceivable for the head to be fixed, for example, by a forehead fastening element, such that a pull on the cervical spine can be applied.

The support element or if appropriate the support elements, in particular a bearing surface of the support element, can be arranged at an angle in the range of 30° to 90° to the backrest.

Such an angle range permits a pleasant, ergonomic positioning of the arms and thus increases the comfort on the chair and thus the efficacy of the latter. The support element can in this case be designed such that an entire upper arm is supported and not just the armpit. In this way, a load provided by the bodyweight of the user is better distributed, which can be advantageous particularly when the chair is used over quite a long period of time. For this purpose, the support element can comprise a suitably designed bearing surface.

The backrest is preferably adjustable with respect to the seat surface in such a way that the backrest angle can be at least in the range of 0° to 90°. The user can thus adopt a position he finds comfortable between the sitting position and a lying position and can obtain optimal relief of the vertebral column.

An inclination of the seat surface is preferably also adaptable, wherein the vertical height of a front edge of the seat surface is preferably designed to be adjustable, and a vertical height of a rear edge is fixed relative to the front edge. "Front" and "rear" relate here to an arrangement with respect to the backrest, where rear means closer to the backrest. A seat surface with adjustable inclination of this kind permits an optimal angle of the thighs in relation to the upper body of a user, which leads to relief of the lumbar spine. Generally, the seat surface is oriented substantially horizontally. However, in a lying position in particular, it may be advantageous to arrange the seat surface substantially parallel to the backrest and flush therewith.

The chair can be designed to be vertically adjustable, in particular the seat surface of the chair can be designed to be vertically adjustable. The chair preferably has a vertically adjustable stand. A vertically adjustable stand makes it easier to get on and off the chair.

The seat surface and/or the backrest can be designed to be heatable. A heatable seat surface and/or backrest makes it possible, simultaneously to the extension, to carry out a thermal treatment of the regions where the user feels pain, such that relaxation of the muscles can be obtained. In this way, muscle tension is also alleviated.

The chair can comprise a lumbar support. A lumbar support leads to an ergonomic sitting or lying position and leads to optimal relaxation of the user.

The seat surface and/or the backrest can comprise, at least in part, a layer of silicone, water, fango or oil. A seat surface or backrest designed in this way has a soft surface and at the same time conducts heat, such that the user finds the chair to be pleasant, warming and thus relaxing to use.

The chair, in particular the operating elements if appropriate, can comprise a device for determining the bodyweight or an input element for inputting the bodyweight of a user.

By inputting or identifying the bodyweight, it is possible to avoid a situation where the support elements or the headrest cause tensile forces that are too great for the particular bodyweight. For this purpose, the operating element preferably has a control system preventing excessive tensile forces from the support elements or the headrest. An excessive tensile force is, for example, a tensile force, which corresponds to the overall bodyweight, exclusively at the headrest. The inputting of the bodyweight can, for example, predefine a minimum backrest angle, such that the effective bodyweight cannot exceed a predefined value, even when the body is supported parallel to the backrest only at the support elements (and not additionally at least in part at the seat surface).

The therapy chair can have a safety device which prevents overloading of a user, e.g. if the wrong bodyweight is accidentally input. For example, the support elements can be mounted on the backrest via a safety coupling with a predefinable or adjustable loading threshold. If the threshold is exceeded, the support elements can be released by the safety coupling, such that the user sinks e.g. with his bodyweight onto the seat surface. In this way, it is possible to prevent overstretching of the vertebral column. In variants, the safety device can also comprise a measuring device for measuring the actual loading of the support elements. The control system of the therapy chair can in this case reset the position of the support elements or an inclination of the chair if overloading occurs. It will be appreciated that, if appropriate, the adjustable headrest can have an analogous safety device.

An armrest can also be formed on the chair. An armrest permits a comfortable position of the arms and leads to optimized wellbeing. As has been mentioned, the operating elements are, if appropriate, advantageously arranged on the armrest.

Moreover, a footrest can be formed on the chair, wherein the footrest is preferably designed to be adjustable independently of the setting of the backrest angle and/or if appropriate of an inclination of the seat surface.

The provision of a footrest prevents the legs of a user from hanging down and thus prevents constriction of veins above the knee. Moreover, an independently adjustable footrest allows the user to adopt a position of the feet that he finds comfortable. Varicose veins are thus prevented.

A bearing surface of the support element for an upper arm can comprise at least 80 $cm^2$, preferably at least 100 $cm^2$, preferably at least 120 $cm^2$, and in particular preferably at least 150 $cm^2$. A bearing surface of this kind permits the comfortable partial or complete positioning of the armpits of the user and prevents constriction of veins and arteries of the upper arm on account of the support element. If the bearing surface is intended for the partial or complete positioning of an upper arm of the user, the bearing surface preferably amounts to approximately 200 $cm^2$ to 400 $cm^2$. The chair is thus more pleasant to use.

The object is also achieved by a table for an ergonomic posture of the user, which table comprises a table top on which to place documents or computers, and a stand device for the positioning of the table top. Between a longitudinal axis of the stand device and a plane of the table top, a table-top angle of approximately 15° to 70°, in particular approximately 20° to 60° and preferably approximately 25° to 50° is formed. The table-top angle is preferably adjustable by a user. It will be appreciated that the table top can be mounted so as to be vertically adjustable with respect to the stand device.

The table comprises at least two side wings which adjoin a respective side edge of the table top and are arranged to be movable with respect to the table top, in particular to be pivotable about a side longitudinal axis along the respective side edge. The side wings are preferably articulated on the table top. The side longitudinal axes can be predefined by suitable pivot bearings between table top and side wing. The pivot bearings can in this case be designed in such a way that the position and/or orientation of the side longitudinal axes relative to the table top and/or to the side wings are adjustable.

A table of this kind permits ergonomic working from a leant-back position. On the one hand, the table top can be brought to an inclined position, in which the table top is easily accessible from a chair placed in front of the table. On the other hand, the side wings can be folded into a position on both sides of the chair placed in front of the table, after a user has sat down in the chair. The side wings thus form an additional work area that is also easily accessible from the chair. This is particularly advantageous, especially in the case of a therapy chair as described here, since the user cannot easily bend forward or sideways from the adopted position, for example, in order to extend his reach. For example, in the case where the armpits are supported, his reach is limited to about an arm's length, starting from the position of the support element of the therapy chair.

A ledge or several ledges can be formed on the table, preferably along a lower edge of the table. Here, lower edge means an edge of the table top near the floor. The ledge is preferably formed at right angles to a table surface. A ledge of this kind forms a stop to prevent objects from sliding down when these are arranged on the table top. Such ledges can also serve for placing the hands when operating a keyboard. It will be appreciated that a corresponding ledge can also advantageously be formed along the lower edges of each of the side wings. The ledge can be made from an elastic material on its lower edge. It is also conceivable to make the entire ledge from plastic.

Each of the sidewise longitudinal axes is inclined with respect to the table top in a first direction by the table-top angle. Deviating from the first direction, the side longitudinal axes can be inclined in a second direction with respect to the longitudinal axis of the stand device. The side longitudinal axes are preferably inclined, in a plane of the table top, running together toward the lower edge, in particular by an angle of approximately 1° to 20° with respect to the longitudinal axis of the stand device.

A table of this kind permits ergonomic working on a large work area, particularly when the reach of a user is restricted by fixing of the shoulders on the chair.

The combination of a chair, which allows the user an inclined sitting position, e.g. by 30°, with a table, which accordingly has an inclined or inclinable top, is also preferred. This allows the user to work in an inclined sitting position, which relieves the lumbar spine.

The table top can be made of wood or of another sufficiently stable material, such that heavy objects, for example a computer, can also be placed on the table.

The table top can have a height of approximately 30 to 100 cm, a width of approximately 50 to 150 cm, and a thickness of approximately 1 to 5 cm. It will be appreciated that, depending on requirements, values outside these ranges are also covered by the inventive concept.

The table top is preferably trapezoidal in shape, wherein a shorter of the two parallel side edges forms the lower edge. In the case of a trapezoid shape, the specified values of the width are to be understood as average width. The side wings are advantageously likewise trapezoidal in shape, wherein a shorter of the two parallel side edges also forms the lower edge in this case too. The trapezoid shapes are each advantageously isosceles trapezoids.

The object is also achieved by a kit composed of a chair as described above and of a table as described above. Such a combination of chair and table leads to the possibility of working ergonomically and of at the same time relieving the vertebral column.

In principle, the table can also be designed as part of the therapy chair and formed directly thereon. In this case, a retaining arm can, for example, extend from a stand device of the therapy chair, on which retaining arm the table top is arranged. In this case, the table-top angle is understood with respect to the direction of gravity, since in this case the table has no dedicated stand device predefining a longitudinal direction.

BRIEF DESCRIPTION OF THE DRAWINGS

The invention is explained in more detail below on the basis of illustrative embodiments and with reference to figures, in which.

DETAILED DESCRIPTION OF THE PREFERRED EMBODIMENTS

Figure 1:
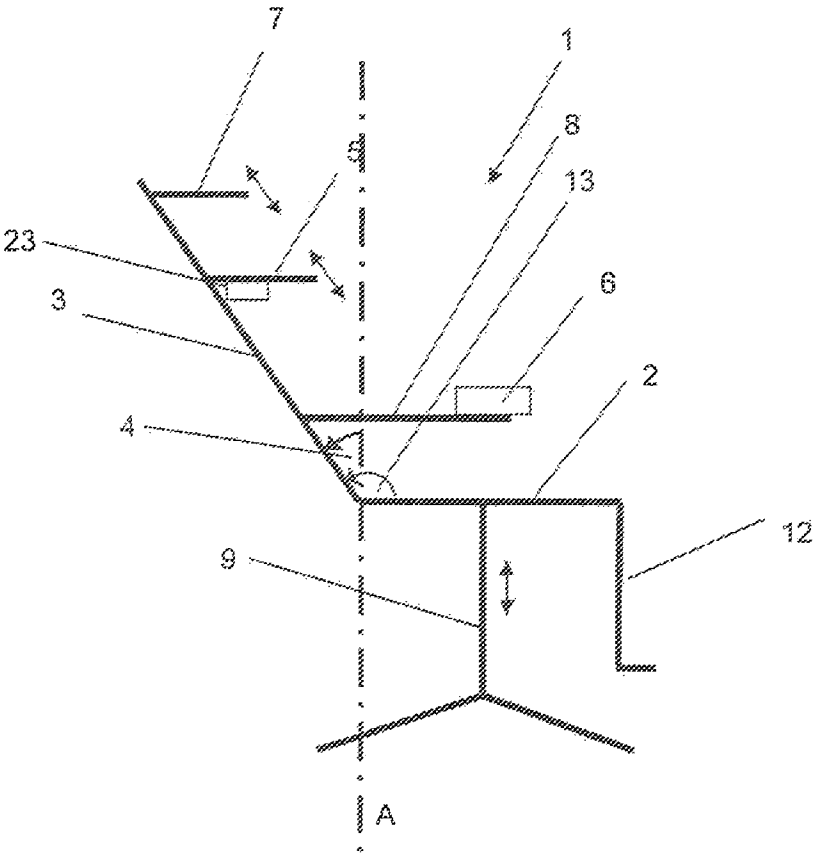
FIG. 1 shows a schematic view of the chair in the sitting position.

FIG. 1 shows a chair 1 according to the invention, with a seat surface 2 and with a backrest 3. The backrest angle 4 between the backrest 3 and a vertical A is designed to be adjustable. The seat surface 2 is horizontal here, i.e. oriented perpendicularly with respect to the vertical A. Moreover, the chair 1 comprises support elements 5 with an electric drive 23, which are formed on the backrest 3 and are adjustable in respect of a distance from the seat surface 2. The support elements 5 protrude from the backrest 3 in such a way that they are arranged on both sides of the upper body of a user, under the arms or armpits. It will be appreciated that the support elements 5 can also be designed in one piece as a single support element 5.

With the aid of operating element 6, a user can set the backrest angle 4 and a position of the support elements 5. Moreover, a headrest 7 is formed, which is likewise adjustable using the operating element 6. When adjusted in the direction of the headrest 7, i.e. in the direction away from the seat surface 2, the support elements 5 lead to an extension of the chest and lumbar spine as a result of the effective bodyweight of the user. The adjustment of the headrest 7 leads to an extension of the cervical spine.

A greater backrest angle 4, in other words a more horizontal orientation of the backrest 3, leads to a reduction of the overall effective bodyweight available for extension, since a greater weight component is carried by the backrest 3. At the very most, only the downhill-slope component of the force of gravity is available for the extension. By adjusting the support elements 5, the user can determine what proportion of this available bodyweight is actually effective in the extension and what proportion is carried by the seat surface 2, for example. In the extreme case, the seat surface 2, for example, is completely unloaded, such that the entire available effective bodyweight is supported only at the support elements 5 and, if appropriate, also the headrest 7.

Armrests 8 are also formed. The operating element 6 is arranged on the armrest 8. The seat surface 2 and the backrest 3 are designed to be heatable. To make use of the chair 1 as pleasant as possible, the seat surface 2 and the backrest 3 comprise a layer or a cushion of silicone. However, it would also be conceivable to provide an air cushion that is inflatable, for example by means of hand bellows or by means of an electric pump. The face of the seat surface 2 and backrest 3 is thus very soft. Moreover, the chair 1 is designed to be vertically adjustable. This is achieved by a vertically adjustable stand 9. A footrest 12 is also formed.

Figure 2:
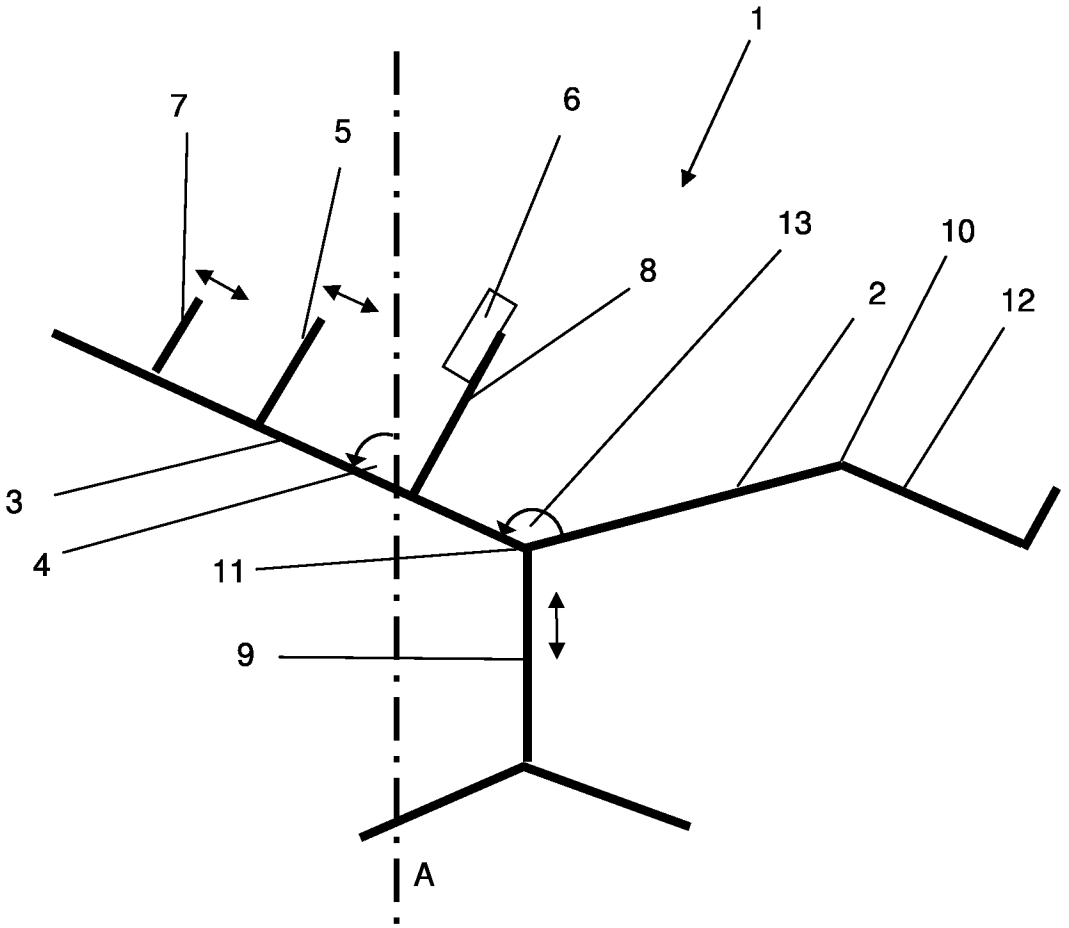
FIG. 2 shows a schematic view of a chair in the lying position.

FIG. 2 shows a schematic view of a chair 1 in a lying position. Analogously to FIG. 1, the chair 1 comprises a seat surface 2 and a backrest 3. The backrest angle 4 between the backrest 3 and the vertical A is ca. 70°. An angle 13 between the seat surface 2 and the backrest 3 is approximately 150°. The seat surface 2 is inclined here. The inclination is achieved by a relative adjustment of the front edge 10 in relation to the rear edge 11 of the seat surface 2. Moreover, the chair comprises the support element 5 and the headrest 7, which are both designed to be adjustable. The backrest angle 4, support element 5 and headrest 7 and the inclination of the seat surface 2 are preferably adjusted by the user via operating element 6. Moreover, the chair 1 is designed to be vertically adjustable on a stand 9. A footrest 12 is also provided, which is likewise adjustable relative to the seat surface 2. Analogously to FIG. 1, the chair 1 from FIG. 2 is also designed with a heatable seat surface 2 and backrest 3.

Figure 3:
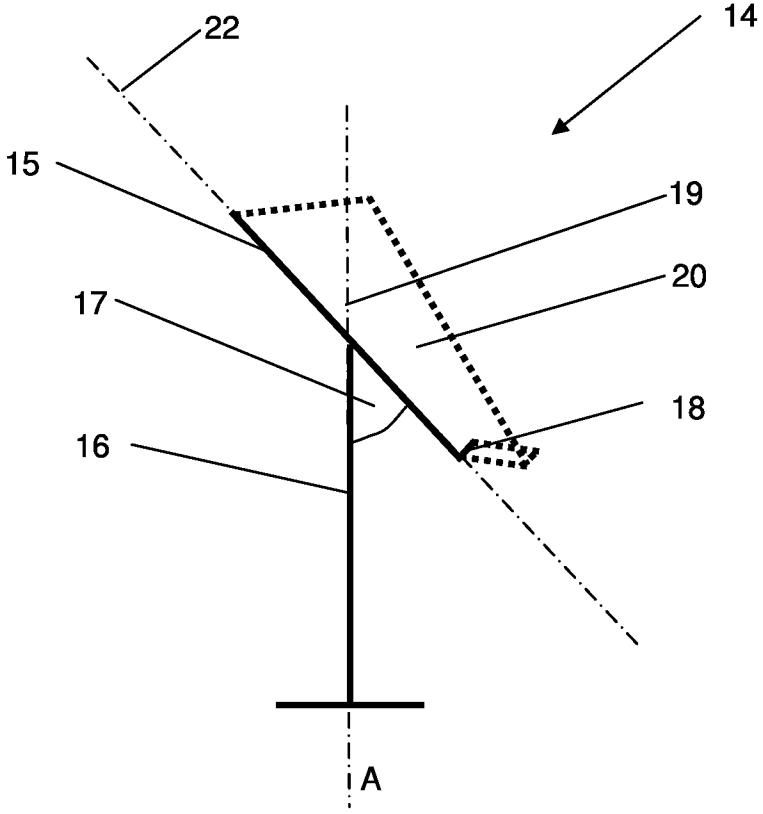
FIG. 3 shows a schematic side view of a table.

FIG. 3 shows a schematic side view of a table 14. The table 14 comprises a table top 15, which is secured on a stand 16. The table top 15 is arranged here in a plane 22, which is at an angle 17 of 45° to the longitudinal axis 19 of the stand 16. A ledge 18 is formed on a lower edge of the table top 15. The table top 15 is made of wood and has a height of approximately 30 to 100 cm, an average width of approximately 50 to 150 cm, and a thickness of approximately 1 to 5 cm.

Figure 4:
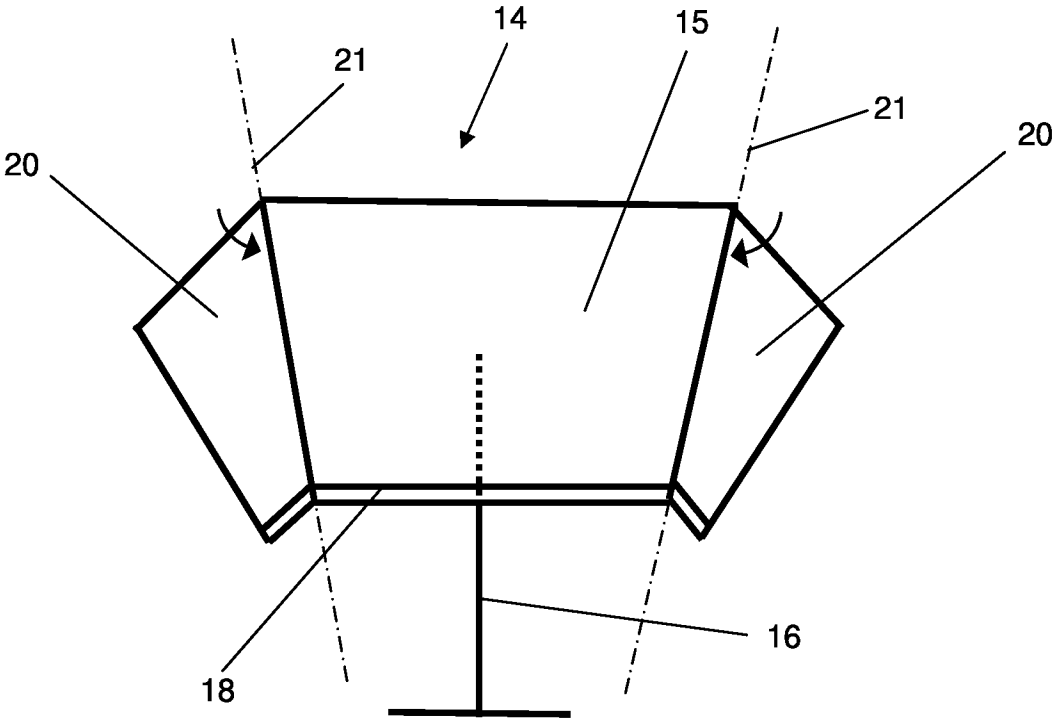
FIG. 4 shows a schematic front view of a table.

FIG. 4 shows a schematic front view of a table 14 from FIG. 3. The table 14 comprises the table top 15 and two side wings 20 (indicated by broken lines in FIG. 3). The side wings 20 are designed to be pivotable out from the table-top plane 22, about the respective side longitudinal axis 21. The table top 15 is secured on a stand 16. The table top 15 has a suitable height allowing it to be arranged in front of the chair 1 (see FIGS. 1 and 2), or it can be arranged at a suitable height by a user. The user, sitting on the chair 1, can thus easily and comfortably reach every area of the table top 15. The side wings 20 also allow the available table surface to be increased on both sides of the user, since, after the user has sat down on the chair 1, they can be folded toward him from the table-top plane 22 from both sides (see arrows).

The table top 15 is trapezoidal in shape, wherein the shorter of the parallel edges of the trapezoid forms the lower edge. The side wings 20 are likewise trapezoidal in shape, wherein the shorter of the two parallel edges likewise forms the lower edge. In this way, an overall work area composed of the table-top surface and of the surface of the side wings is made available, which work area runs together in a funnel shape toward a user in the chair.

The invention claimed is:

1. A chair for relieving back pain of a user, the chair comprising:

a seat surface, a backrest, armrests, at least one operating element supported by an armrest, support elements, and a vertically adjustable stand which supports the seat surface, the backrest, the support elements, the armrests and the at least one operating element, wherein a backrest angle of the backrest, with respect to both the seat surface and a vertical, is adjustable by the user via operation of the at least one operating element when the user is seated in an intended position of the chair, the support elements are arranged on opposed sides of the backrest, the support elements are electrically connected to an electric drive, the electric drive is electrically connected to and controlled by the at least one operating element for controlling a position of each of the support elements relative to the backrest and the seat surface, the at least one operating element is located on one of the armrests of the chair for manipulation by the user, when the user is in the intended position, to facilitate adjustment of a position of the support elements relative to the backrest and seat surface, and the support elements, when the user is seated in the intended position of the chair, are height-adjustable relative to the seat surface via operation of the at least one operating element by the user so that, at a predefined backrest angle, the support elements are moved under armpits of the user to obtain desired support of an upper body of the user while the user is seated on the chair in the intended position.

2. A chair for relieving back pain of a user, the chair comprising:

a seat surface, and a backrest pivotably connected to the seat surface, wherein a backrest angle of the backrest is adjustable with respect to the seat surface, the backrest supports a pair of support elements for supporting the upper body of the user, when the upper body of the user seated in the chair is in an intended position, the support elements are arranged on the backrest so that the support elements can be moved, by the user, in order to obtain desired support of the upper body at a predefined backrest angle while the user is in the intended position, the support elements can be arranged or are arrangeable under armpits of the user, and, in the intended position, the support elements are arranged under the armpits of the user, the support elements, in the intended position, are height-adjustable relative to the seat surface, the chair comprises at least one operating element by which the backrest angle and the position of the support elements are settable by the user when the user is in the intended position, the support elements are electrically connected to an electric drive, the electric drive is controlled by the at least one operating element.

3. The chair as claimed in claim 2, wherein the support elements are arranged at an angle in a range of 30° to 90° relative to the backrest.

4. The chair as claimed in claim 2, wherein the backrest is adjustable in such a way that the backrest angle is adjustable over a range of 90° to 180°.

5. The chair as claimed in claim 2, wherein at least one of the seat surface and the backrest are heatable.

6. The chair as claimed in claim 2, wherein the chair comprises a lumbar support.

7. The chair as claimed in claim 2, wherein at least one of the seat surface and the backrest comprise, at least in part, a layer of silicone, water, fango or oil, or an inflatable air cushion.

8. The chair as claimed in claim 2, wherein the chair comprises a device for determining the bodyweight or an input element for inputting the bodyweight of the user.

9. The chair as claimed in claim 2, wherein the chair comprises armrests.

10. The chair as claimed in claim 2, wherein the support elements are support elements for upper arms and comprises bearing surfaces of at least 80 square cm.

11. The chair as claimed in claim 2, wherein the backrest and the support elements are simultaneously adjustable by the user.

12. The chair as claimed in claim 11, wherein the backrest and the support elements are adjustable via the at least one operating element.

13. The chair as claimed in claim 2, wherein an inclination of the seat surface is adaptable.

14. The chair as claimed in claim 13, wherein a vertical height of a front edge of the seat surface is adjustable, and a vertical height of a rear edge of the seat surface is fixed relative to the front edge.

15. The chair as claimed in claim 2, wherein the chair comprises a footrest.

16. The chair as claimed in claim 15, wherein the footrest is adjustable independently of the setting of the backrest angle.

17. The chair as claimed in claim 2, wherein via the at least one operating element the support elements can be moved by the user in the intended position.

18. The chair as claimed in claim 17, wherein the at least one operating element is arranged in an area of an armrest of the chair.

19. The chair as claimed in claim 17, wherein the at least one operating element comprises a device for determining a bodyweight or an input element for inputting the bodyweight of the user.

20. The chair as claimed in claim 2, wherein an adjustable headrest, is, arranged on the chair and is designed so that an extension of a cervical spine of the user can be obtained.

21. The chair as claimed in claim 20, wherein the headrest is adjustable by the user.

22. The chair as claimed in claim 21, wherein the headrest is adjustable by the at least one operating element.

23. The chair as claimed in claim 2, wherein the chair is vertically adjustable.

24. The chair as claimed in claim 23, wherein the seat surface is vertically adjustable.

25. The chair as claimed in claim 23, wherein the chair has a vertically adjustable stand.

* * * * *